US005449573A

United States Patent [19]

Aoki et al.

[11] Patent Number: 5,449,573

[45] Date of Patent: Sep. 12, 1995

[54] METHOD FOR MANUFACTURING AN ELECTROPHOTOGRAPHIC PHOTORECEPTOR

[75] Inventors: Kazuaki Aoki; Nobuyuki Ichizawa; Wataru Nakabayashi, all of Minami Ashigara; Hiroshi Miyamoto; Koichi Yasaku, both of Ebina; Masaaki Suwabe; Naohiko Tsuyuki, both of Minami Ashigara, all of Japan

[73] Assignee: Fuji Xerox Co., Ltd., Tokyo, Japan

[21] Appl. No.: 132,251

[22] Filed: Oct. 6, 1993

[30] Foreign Application Priority Data

Oct. 9, 1992 [JP] Japan ..... 4-296563

[51] Int. Cl.[6] ..... G03G 5/14

[52] U.S. Cl. ..... 430/131; 430/132; 430/134

[58] Field of Search ..... 430/131, 132, 134

[56] References Cited

U.S. PATENT DOCUMENTS 5,240,802 8/1993 Molaire et al. ..... 430/67

FOREIGN PATENT DOCUMENTS 61-94057 5/1986 Japan .

2-59767 2/1990 Japan .

124674 4/1992 Japan ..... 430/131

*Primary Examiner*—Roland Martin

*Attorney, Agent, or Firm*—Oliff & Berridge

[57] ABSTRACT

There is disclosed a process for manufacturing an electrophotographic photoreceptor having no coating defect, a high charging performance, an excellent stability in a repeated use, and no image quality defect. The manufacturing process comprises the steps of coating a subbing layer-forming coating solution on the conductive substrate under an environment having a dew-point temperature in the range of from 5° C. to 10° C.; drying the coated solution under an environment having a dew-point temperature in the range of from 10° C. to 20° C. to prepare a subbing layer; coating a photosensitive layer-forming coating solution on the subbing layer under an environment having a dew-point temperature in the range of from 5° C. to 10° C.; and drying the coated solution under an environment having a dew-point temperature in the range of from 10° C. to 20° C. to prepare a photosensitive layer.

19 Claims, 1 Drawing Sheet

METHOD FOR MANUFACTURING AN ELECTROPHOTOGRAPHIC PHOTORECEPTOR

FIELD OF THE INVENTION

The present invention relates to a process for manufacturing an electrophotographic photoreceptor.

BACKGROUND OF THE INVENTION

In the electrophotographic photoreceptor used for a copying machine, a laser printer, and an LED printer, in which an electrophotographic system is used, there has so far been involved the problem that a charging performance is inferior and a stability in a repeated use is short when an organic compound is used as a charge generating material. Particularly in recent years, a process in which the surface of a conductive substrate is roughened by various means is applied in a photoreceptor for the laser printer in order to prevent the generation of an interference fringe. In this case, there used to be involved the problems that the coating defects such as a resist spot and a convex portion formed by foreign matter generate when a charge generating layer is coated on the roughened substrate surface and that the local injection of a charge from a substrate generates a black spot and a blank area on an image.

It is generally known as the means for solving these problems to provide a subbing layer between a conductive substrate and a charge generating layer.

There are known as the material for forming the subbing layer, a thermoplastic resin such as polyvinyl acetate, polyvinyl alcohol, polyvinyl butyral, polyvinyl methyl ether, polyamide, thermoplastic polyester, a phenoxy resin, casein, gelatin, and cellulose nitrate, and a thermosetting resin such as polyimide, polyethyleneimine, an epoxy resin, a melamine resin, a phenol resin, and a polyurethane resin.

However, in the case where these resins are used to form the subbing layer, the increase in a layer thickness to improve a charging performance, a coating performance, and a controlling performance for an image quality defect causes the reduction of a sensitivity and the increase in a residual potential in a repeated use. Meanwhile, in the case where the layer thickness is decreased in order to improve these characteristics, there is involved the problem that the charging performance, the coating performance, and the image quality defect can not sufficiently be controlled.

Further, there has been tried the method in which the organic or inorganic conductive particles are dispersed in a resin in order to avoid the problems caused when the thickness of the subbing layer is increased but an expected performance has not been able to obtain.

On the contrary, it is known as shown in JP-A-61-94057 (the term "JP-A" as used herein means an unexamined published Japanese patent application) that the use of the subbing layer containing an organic metal compound as a main component can control a coating defect and an image quality defect without causing the reduction of a sensitivity and the increase in a residual potential.

In the case where there is applied the method in which the coating solution comprising an organic metal compound and a silane coupling agent is used for coating and drying to form the subbing layer, the hardening degree of the subbing layer is under the control of an environment after coating to a large extent. That is, the subbing layer dried at a lower temperature after coating has the lower hardening degree. Further, it was found that in an electrophotographic photoreceptor comprising a photosensitive layer provided on this subbing layer, a residual potential at an initial stage is high under a low temperature and a low humidity and that a residual potential in a repeated use is markedly increased.

Further, in case of the subbing layer containing only an organic metal compound as a main component, the layer obtained after coating and drying is liable to crack and therefore it is difficult to increase a layer thickness to about 0.3 μm or more. Meanwhile, in the case where a photosensitive layer is formed on the conductive substrate having the surface which is toughened for the measure to prevent an interference fringe as described above, the subbing layer is required to have a layer thickness thick enough to sufficiently cover an irregularity on a substrate surface. However, the subbing layer containing the above organic metal compound as the main component can not meet it.

There is disclosed in JP-A-2-59767, the subbing layer comprising an organic titanium compound, a silane coupling agent and a polyvinyl acetal resin, and the subbing layers having the thickness of 1 to 3 μm are shown in the examples. However, according to the investigations by the present inventors, it has been found that the reduction of a sensitivity particularly under a low temperature and a low humidity and the increase in a residual potential are notable at the added amount of the polyvinyl acetal resin shown there.

SUMMARY OF THE INVENTION

The present invention has been made for the purpose to solve the above mentioned problems in the conventional techniques.

That is, the object of the present invention is to provide a process for manufacturing an electrophotographic photoreceptor having no coating defect, a high charging performance, an excellent stability in a repeated use, and no image quality defect.

Further, the other object of the present invention is to provide a process for manufacturing an electrophotographic photoreceptor showing a stable charging performance and a low residual potential under a high temperature and a high humidity through a low temperature and a low humidity.

Various investigations made by the present inventors resulted in finding that the above objects could be achieved by carrying out the coated layer formation of a subbing layer and a photosensitive layer under an environment having a specific dew-point temperature range in manufacturing an electrophotographic photoreceptor and coming to complete the present invention.

That is, the present invention relates to a manufacturing process for an electrophotographic photoreceptor comprising a conductive substrate having thereon a subbing layer and a photosensitive layer, which comprises the steps of:

coating a subbing layer-forming coating solution on the conductive substrate under an environment having a dewpoint temperature in the range of from 5° C. to 10° C.;

drying the coated solution under an environment having a dew-point temperature in the range of from 10° C. to 20° C. to prepare a subbing layer;

coating a photosensitive layer-forming coating solution on the subbing layer under an environment having a dew-point temperature in the range of from 5° C. to 10° C.; and drying the coated solution under an environment having a dew-point temperature in the range of from 10° C. to 20° C. to prepare a photosensitive layer.

DETAILED DESCRIPTION OF THE INVENTION

The present invention will be explained below in detail.

Figure 1:
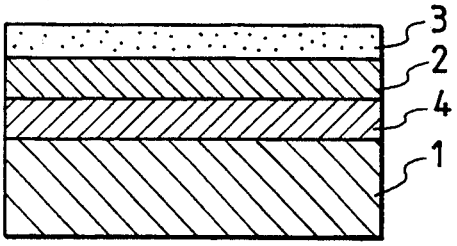
FIG. 1 is a schematic view showing the section of one example of the electrophotographic photoreceptor manufactured by the process of the present invention, wherein 1 represents a conductive substrate, 2 represents a charge generating layer, 3 represents a charge transporting layer, and 4 represents a subbing layer.

The electrophotographic photoreceptor manufactured by the process of the present invention comprises a conductive substrate, a subbing layer and a photosensitive layer. The photosensitive layer may be either of a single layer structure or a laminated structure in which a charge generating layer and a charge transporting layer are functionally separated. The present invention will be explained below mainly regarding the case in which the photosensitive layer has the laminated structure as shown in FIG. 1 but will not be limited thereto.

In the present invention, specific examples of the conductive substrate which is a coated substrate include a metal-made drum and sheet of aluminum, copper and stainless steel, those prepared by laminating a metal foil of aluminum and others on a plastic film and a paper, those prepared by depositing aluminum and other metals, and those prepared by coating a resin layer in which conductive particles are dispersed on a metal- or resin-made drum. The surface of the above metal-made drum may be subjected to a toughening treatment for preventing an interference fringe according to necessity.

First, the subbing layer is formed on the above conductive substrate. There is used for forming the subbing layer, a subbing layer-forming coating solution containing an organic metal compound and a silane coupling agent and further containing a binding resin according to necessity.

The following ones are used as the organic metal compound according to the valency of metal. Specific examples of the compound having the metal of a IV valency include a zirconium compound such as a zirconium chelating agent including tetraacetylacetonate zirconium, dibutoxybisacetylacetonate zirconium, tributoxyacetylacetonate zirconium, tetrakisethylacetoacetate zirconium, butoxytrisethylacetoacetate zirconium, tributoxymonoethylacetoacetate zirconium, dibutoxybisethyllactate zirconium, bisacetylacetonatebisethylacetoacetate zirconium, monoacetylacetonatetrisethylacetoacetate zirconium, and bisacetylacetonatebisethyllactate zirconium, and zirconium alkoxide including zirconium n-butoxide and zirconium n-propoxide.

There can be enumerated as a titanium compound, titanium orthoester represented by formula (I), polyorthotitanic acid ester represented by formula (II), and a titanium chelating compound represented by formula (III):

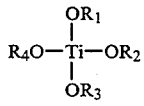

(I)

wherein $R_1$, $R_2$, $R_3$, and $R_4$ each represents a methyl group, an ethyl group, an n-propyl group, an isopropyl group, an n-butyl group, an isobutyl group, a cresyl group, a stearyl group, a hexyl group, a nonyl group, and acetyl group;

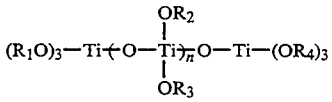

(II)

wherein $R_1$, $R_2$, $R_3$, and $R_4$ each represents a methyl group, an ethyl group, an n-propyl group, an isopropyl group, an n-butyl group, an isobutyl group, a cresyl group, a stearyl group, a hexyl group, a nonyl group, and acetyl group; and n represents an integer of from 2 to 20, preferably from 2 to 10;

$$Ti(L)_nX_{4-n} \quad \text{(III)}$$

wherein L represents a chelating group; X represents an ester residue; and n represents an integer of from 1 to 4.

There can be enumerated as a ligand specie for forming the chelating group, β-diketone such as octylene glycol and acetylacetone, hydroxycarboxylic acid such as lactic acid, malic acid, tartaric acid, and salicylic acid, ketoester such as acetoacetic acid ester, and ketoalcohol such as diacetone alcohol. Further, the residue of titanic acid ester such as an alkoxy group can be enumerated as the ester residue.

Specific examples of the titanium chelating compound include di-i-propoxy-bis(acetylacetone)titanate, di-n-butoxy-bis(triethanolamine)titanate, dihydroxybis(lactic acid)titanate, tetraoctylene glycol titanate, and di-i-propoxybis(ethyl acetoacetate)titanate.

Specific examples of the compound having the metal of a III valence include aluminum alkoxide such as aluminum isopropoxide, monosec-butoxyaluminum diisopropoxide, aluminum sec-butoxide, and aluminum ethoxide; an aluminum chelating compound such as diisopropoxy-(ethylacetoacetate)aluminum, tris(ethylacetoacetate)aluminum, tris(acetylacetonate)aluminum, and bisethylacetoacetatemonoacetylacetonatealuminum; indium alkoxide such as indium methoxide, indium ethoxide, indium isopropoxide, and indium n-butoxide; antimony alkoxide such as antimony methoxide, antimony ethoxide, antimony isopropoxide, and antimony n-butoxide; and boron alkoxide such as boron methoxide and boron n-butoxide.

Specific examples of the compound having the metal of a II valence include bis(acetylacetonate)manganese, bis(acetylacetonate)zinc, and bis(acetylacetonate)tin.

Specific examples of the silane coupling agent include vinyltrichlorosilane, vinyltriethoxysilane, vinyltris(β-methoxyethoxy)silane, γ-glycidoxypropyltrimethoxysilane, γ-methacryloxypropyltrimethoxysilane, γ-aminopropylmethyldimethoxysilane, γ-chloropropyltrimethoxysilane, γ-mercaptopropyltrimethoxysilane, γ-aminopropyltrimethoxysilane, γ-aminopropyltriethoxysilane, methyltrimethoxysilane, dimethyldimethoxysilane, trimethylmonomethoxysilane, diphenyldimethoxysilane, diphenyldiethoxysilane, monophenyltrimethoxysilane, γ(2-aminoethyl)aminopropyltrimethoxysilane, γ-(2-aminoethyl)aminopropylmethyldimethoxysilane, and γ-methacryloxypropyltrimethoxysilane.

There are used as a binding resin, a polyurethane resin, a polyvinylbutyral resin, a polyvinylformal resin, and a polyvinyl acetate resin. Any ones can be used as a solvent as long as they are publicly known.

A subbing layer-forming coating solution can be prepared by mixing the above organic metal compound and silane coupling agent and the binding resin according to necessity and then diluting with a solvent, wherein the organic metal compound, the silane coupling agent and the binding resin each may be used singly or in the mixture of two or more kinds. The amount of the silane coupling agent to that of the organic metal compound can arbitrarily be set in the range of 5% to 95% by weight, preferably in the range of 5% to 50% by weight, and more preferably in the range of 5% to 20% by weight.

Specific examples of the solvent include alcohols such as ethanol, methanol, propanol, butanol, etc., aromatic hydrocarbons such as toluene, and esters such as ethyl acetate, cellosolve acetate, etc. The solvent may be used singly or in the mixture of two or more kinds.

In the case where the binding resin is incorporated, the amount of the binding resin to the total amount of the organic metal compound and the silane coupling agent is preferably set in the range of 5% to 25% by weight.

The above subbing layer-forming coating solution is applied on a conductive substrate by, for example, a spray coating method and a dip coating-method and then dried. In the present invention, it is required to carry out coating under an environment having a dew-point temperature in the range of from 5° C. to 10° C. and carry out drying under an environment having a dew-point temperature in the range of from 10° C. to 20° C. The environmental dew-point temperatures higher than the above ranges in coating and drying cause blushing (the phenomenon in which since a solvent absorbs a heat when it is vaporized and the surface temperature of a coated layer is lowered, moisture in air is condensed for dew formation and adsorbed on the surface of the layer to make the layer irregular or bore a hole and make the layer white). The temperatures lower than the above ranges increase the residual potential of the resulting electrophotographic photoreceptor and deteriorates the characteristics in a repeated use. In the present invention, the coating of the subbing layer-forming coating solution is carried out preferably in the temperature range of from 20° C. to 25° C. and the drying of the coated solution is carried out preferably in the temperature range of from 150° C. to 200° C.

The layer thickness of the subbing layer is arbitrarily set in the range of from 0.1 to 10 μm. The range of 0.5 to 1 μm is particularly preferred.

Subsequently, a photosensitive layer is formed on the subbing layer thus formed. In the case where the photosensitive layer consists of a charge generating layer and a charge transporting layer, either may be provided earlier in the laminating sequence thereof.

There are independently prepared and coated on the above mentioned subbing layer, a charge generating layer-forming coating solution obtained by dispersing and dissolving a charge generating material and a binder resin in a solvent and a charge transporting layer-forming coating solution obtained by dispersing and dissolving a charge transporting material and a binder resin in a solvent, followed by drying, whereby the charge generating layer and the charge transporting layer are formed.

Specific examples of the solvent which can be used for preparing photosensitive layers such as a charge generating layer and a charge transporting layer include alcohols (e.g., methanol, ethanol, and isopropanol); ketones (e.g., acetone, methyl ethyl ketone, and cyclohexanone); amides (e.g., N,N-dimethylformamide, and N,N-dimethylacetoamide); dimethylsulfoxides; ethers (e.g., tetrahydrofuran, dioxane, and ethylene glycol monomethylether); esters (e.g., methyl acetate and ethyl acetate); aliphatic hydrocarbonhalides (e.g., chloroform, methylene chloride, dichloroethylene, tetrachlorocarbon, and trichloroethylene); and aromatic hydrocarbons (e.g., benzene, toluene, monochlorobenzene, and dichlorobenzene).

There can be used as the charge generating material, for example, an azo dye such as Chlorodian Blue, a quinone pigment such as anthoanthorone and pyrenequinone, a quinocyanine pigment, a perylene pigment, an indigo pigment, a bisbenzimidazole pigment, a phthalocyanie pigment such as a copper phthalocyanine, vanadyl phthalocyanine, and titanyl phthalocyanine, an azulenium salt, a squarylium pigment, and a quinacridone pigment.

There can be used as the charge transporting material, for example, a polycyclic aromatic compound such as anthracene, pyrene, and phenanthrene, a compound having a nitrogen-containing heterocycle, such as indole, carbazole, and imidazole, a pyrazoline compound, a hydrazone compound, a triphenylmethane compound, a triphenylamine compound, an enamine compound, and a stilbene compound.

Anyone can be applied as the binding resin as long as it has a layer-forming character, and there can be used, for example, polyester, polysulfone, polycarbonate, and polymethyl methacrylate.

Anyone can be used as the solvent as long as it is publicly known.

The above charge generating layer-forming coating solution and charge transporting layer-forming coating solution are coated on the subbing layer formed on a conductive substrate by, for example, a spray coating method and a dip coating method, and then dried. Similarly to the case in forming the above mentioned subbing layer, it is required to carry out the coating under an environment having a dew-point temperature in the range of 5° to 10° C. and carry out the drying under an environment having a dew-point temperature in the range of 10° to 20° C. The environmental dew-point temperatures higher than the above ranges in coating and drying cause blushing, and the temperatures lower than the above ranges increase the residual potential of the resulting electrophotographic photoreceptor and deteriorates the characteristics in a repeated use.

In case of the charge generating layer formation, coating is carried out preferably in the temperature range of from 20° C. to 25° C. and drying is carried out preferably in the temperature range of from 80° C. to 120° C.

In case of the charge transporting layer formation, coating is carried out preferably in the temperature range of from 20° C. to 25° C. and drying is carried out preferably in the temperature range of from 100° C. to 150° C.

Usually, the layer thickness of the charge generating layer is arbitrarily set in the range of from 0.1 to 5 μm. The range of 0.2 to 2 μm is particularly preferred.

The layer thickness of the charge transporting layer is arbitrarily set in the range of from 5 to 30 μm. The range of 15 to 25 μm is particularly preferred.

Figure 2:
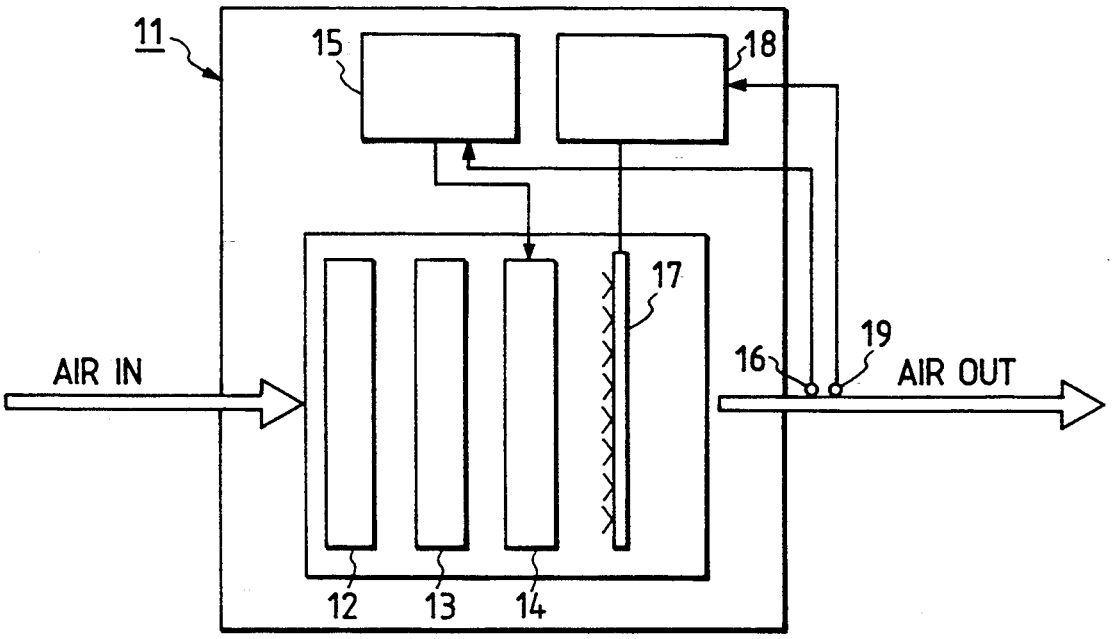
FIG. 2 is a schematic view of a dew-point temperature controlling apparatus which can be used in the present invention.

In the process of the present invention, a dew-point temperature controlling apparatus as shown in FIG. 2 may be used for controlling the dew-point temperature. In FIG. 2, the dew-point temperature controlling apparatus 11 is composed of filter 12 for removing a foreign matter from air which is taken into from outside, cooling means 13, heating coil 14, temperature controlling means 15 for controlling the heating temperature at the heating coil 14, humidifying/drying means 17, and humidity controlling means 18. Temperature in the apparatus can appropriately be controlled by monitoring the temperature of emission air with temperature sensor 16 which is set at the emission part. Further, humidity of the intake air can be controlled by means of 17 and 18, and the suitable dew-point temperature can be maintained by means of humidity sensor 19.

The dew-point temperature controlling apparatus 11 can be set at a coating/drying system so that the air controlled to a suitable dew-point temperature is supplied to the system.

As described above, air having the above dew-point temperature ranges is used as the environment in applying the subbing layer-forming coating solution, the charge generating layer-forming coating solution and the charge transporting layer-forming coating solution and in drying the coated layers thus formed, whereby the resulting electrophotographic photoreceptor has excellent electrophotographic characteristics. That is, the electrophotographic photoreceptor does not cause the increase in a residual potential in a repeated use and shows a stable charging performance and a low residual potential at a high temperature and a high humidity through a low temperature and a low humidity.

The present invention will be explained below in more details with reference to the examples and the comparative examples. Unless otherwise indicated, all parts are by weight.

EXAMPLES 1 TO 4 AND COMPARATIVE EXAMPLES 1 TO 5

| Formation of the subbing layer: | |
|---|---|
| Tributoxyacetylacetonate zirconium $[(C_5H_7O_2)Zr)OC_4H_9)_3$, Orgatics ZC540, manufactured by Matsumoto Kosho Co., Ltd.] | 20 parts |
| γ-Aminopropyltriethoxysilane | 2 parts |
| Polyvinyibutyral resin (S-Lec BM-S, manufactured by Sekisui Chemical Co., Ltd.) | 1.5 parts |
| n-Butyl alcohol | 70 parts |

A solution consisting of the above components was coated on an aluminum pipe with the size of 84 mm (diameter) ×340 mm by dipping and then dried at 150° C. for 10 minutes, whereby a subbing layer having the layer thickness of 0.9 μm was formed.

| Formation of the charge generating layer: | |
|---|---|
| X type non-metal phthalocyanine | 5 parts |
| Vinyl chloridevinyl acetate copolymer (VMCH, manufactured by Union Carbide Co., Ltd.) | 5 parts |
| n-Butyl acetate | 200 parts |

Next, a dispersion obtained by dispersing the above components with a sand mill using glass beads having the diameter of 1 mm for 2 hours was coated on the above subbing layer by dipping and then dried at 100° C. for 10 minutes, whereby a charge generating layer having the layer thickness of 0.2 μm was formed.

Formation of the charge transporting layer:

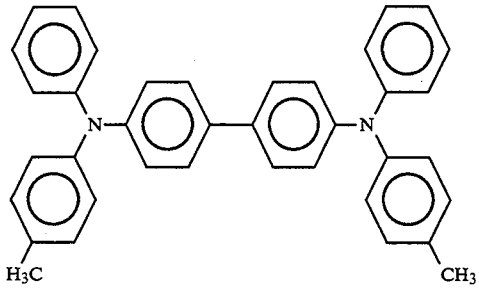

1 part

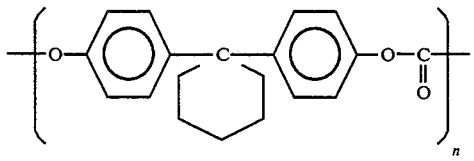

1 part

Monochlorobenzene 6 parts

Next, a solution consisting of the above components was coated on the above charge generating layer by dipping and then dried at 135° C. for 1 hour to form the charge transporting layer having the layer thickness of 20 μm, whereby an electrophotographic photoreceptor was prepared.

In the above respective examples and comparative examples, the dew-point temperature in the environment in coating each of the subbing layer, the charge generating layer and the charge transporting layer and the dew-point temperature in the environment in drying were as described in Table 1.

Evaluation

The thus obtained electrophotographic photoreceptor was subjected to the evaluation of the electrical characteristics in the evaluating equipment obtained by remodeling the laser printer (Able 1301 α manufactured by Fuji Xerox Co., Ltd.). The evaluation was carried out by measuring an initial residual potential and a residual potential after processing 50,000 times at the developing site in the above evaluating equipment at a low temperature and a low humidity (10° C. and 15% RH), wherein the residual potential was defined by the residual potential immediately before stopping the printer. The results thereof are shown in Table 1.

TABLE 1

| | Dew-point temp. of environment in coating (°C.) | Dew-point temp. of environment in drying (°C.) | Initial residual potential (V) | Residual potential after processing 50,000 times (V) |
|---|---|---|---|---|
| Example 1 | 5 | 10 to 12 | −38 | −66 |
| Example 2 | 10 | 10 to 12 | −36 | −65 |
| Comparative Example 1 | 13 | 10 to 12 | — | |
| Comparative Example 2 | −3 | 10 to 12 | −46 | −76 |
| Example 3 | 5 | 10 to 12 | −35 | −57 |
| Example 4 | 5 | 15 to 20 | −36 | −54 |
| Comparative Example 3 | 5 | 25 to 30 | — | — |
| Comparative Example 4 | 5 | −5 | −46 | −82 |
| Comparative Example 5 | 5 | 0 to 3 | −39 | −87 |

In cases of Comparative Examples 1 and 3, blushing took place and therefore the evaluation was impossible.

In these Examples and Comparative Examples, there is the following relationship among the dew-point temperature, relative humidity, and room temperature:

$$RH = f(RT,DP) = \exp\left\{\frac{4892 \times (DP - RT)}{(RT + 273)(DP + 273)}\right\} \times 100$$

$$DP = f(RT,RH) = \frac{4892}{[4892/(RT + 273)] - [\ln(RH/100)]} - 273$$

*RT:* room temperature (°C.)
*RH:* relative humidity (%)
*DP:* dew-point temperature (°C.)

A simplified DP chart from RH and RT is shown in Table 2 below.

TABLE 2

| RH | RT 20° C. | RT 25° C. | RT 37.5° C. |
|---|---|---|---|
| 25% | 0.0° C. | 4.0° C. | 14.3° C. |
| 50% | 11.0° C. | 15.5° C. | 27.0° C. |
| 60% | 12.0° C. | 17.0° C. | 28.4° C. |
| 85% | 17.5° C. | 22.3° C. | 34.7° C. |

While the invention has been described in detail and with reference to specific embodiments thereof, it will be apparent to one skilled in the art that various changes and modifications can be made therein without departing from the spirit and scope thereof.

What is claimed is:

1. A manufacturing process for producing an electrophotographic photoreceptor comprising a conductive substrate having thereon a subbing layer and a photosensitive layer, comprising the steps of:

coating a subbing layer-forming coating solution on the conductive substrate under an environment having a dew-point temperature in the range of from 5° C. to 10° C.; drying the coated solution under an environment having a dew-point temperature in the range of from 10° C. to 20° C. to prepare a subbing layer;

coating a photosensitive layer-forming coating solution on the subbing layer under an environment having a dew-point temperature in the range of from 5° C. to 10° C.; and drying the coated solution under an environment having a dew-point temperature in the range of from 10° C. to 20° C. to prepare a photosensitive layer;

wherein said subbing layer contains an organic metal compound, a silane coupling agent and a binder resin and said coating solution contains a binder.

2. A manufacturing process as in claim 1, wherein said subbing layer contains an organic metal compound and a silane coupling agent.

3. A manufacturing process as in claim 2, wherein said subbing layer further contains a binding resin.

4. A manufacturing process as in claim 3, wherein said binding resin is a polyvinylbutyral resin.

5. A manufacturing process for producing an electrophotographic photoreceptor comprising a conductive substrate having thereon a subbing layer and a photosensitive layer, wherein said subbing layer contains an organic metal compound, a silane coupling agent and a binder resin and said coating solution contains a binder, comprising the steps of:

coating a subbing layer-forming coating solution on the conductive substrate;

drying the coated solution;

coating a photosensitive layer-forming coating solution on the subbing layer; and drying the coated solution;

further comprising controlling the environment during said coating steps at a dew point temperature in the range of from 5° C. to 10° C.; and controlling the environment of said drying steps at a dew point temperature in the range of from 10° C. to 20° C.

6. A manufacturing process as claimed in claim 5, wherein said organic metal compound comprises a zirconium compound or titanium compound.

7. A manufacturing process as claimed in claim 6, wherein said zirconium compound is selected from the group consisting of tetraacetylacetonate zirconium, dibutoxybisacetylacetonate zirconium, tributoxyacetylacetonate zirconium, tetrabisethylacetoacetate zirconium, butoxytrisethylacetoacetate zirconium, tributoxymonoethylacetoacetate zirconium, dibutoxybisethylacetoacetate zirconium, bisacetylacetonatebisethylacetoacetate zirconium, monoacetylacetonatetrisethylacetoacetate zirconium, bisacetylacetonatebisethylacetoacetate zirconium, zirconium n-butoxide and zirconium n-propoxide.

8. A manufacturing process as claimed in claim 6, wherein said titanium compound comprises titanium orthoester represented by formula (I), polyorthotitanic acid ester represented by formula (II) or titanium chelating compound represented by formula (III):

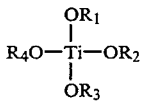

(I)

wherein $R_1$, $R_2$, $R_3$, and $R_4$ each represents a methyl group, an ethyl group, an n-propyl group, an isopropyl group, an n-butyl group, an isobutyl group, a cresyl group, a stearyl group, a hexyl group, a nonyl group or acetyl group;

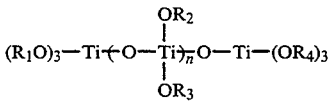

(II)

wherein $R_1$, $R_2$, $R_3$ and $R_4$ each represents a methyl group, an ethyl group, an n-propyl group, an isopropyl group, an n-butyl group, an isobutyl group, a cresyl group, a stearyl group, a hexyl group, a nonyl group or a cetyl group; and n represents an integer of from 2 to 20, preferably from 2 to 10;

$$Ti(L)_nX_{4-n} \quad \text{(III)}$$

wherein L represents a chelating group; X represents an ester residue; and n represents an integer of from 1 to 4.

9. A manufacturing process as claimed in claim 8, wherein said chelating group is a β-diketone, a hydroxycarboxylic acid, a ketoester or a ketoalcohol.

10. A manufacturing process as claimed in claim 8, wherein said chelating group is octylene glycol, acetylacetone, lactic acid, malic acid, tartaric acid, salicylic acid, acetoacetic acid ester or diacetone alcohol.

11. A manufacturing process as claimed in claim 8, wherein said ester residue is an alkoxy group.

12. A manufacturing process as claimed in claim 8, wherein said titanium compound is a titanium chelating compound selected from the group consisting of di-i-propoxy-bis(acetylacetone)titanate, di-n-butoxy-bis(-triethanolamine)titanate, dihydroxy-bis(lactic acid)titanate, tetraoctylene glycol titanate or di-i-propoxybis-(ethyl acetoacetate)titanate.

13. A manufacturing process as claimed in claim 5, wherein said organic metal compound is an aluminum alkoxide, an aluminum ethoxide, an indium alkoxide, an antimony alkoxide or a boron alkoxide.

14. A manufacturing process as claimed in claim 13, wherein said organic metal compound is aluminum isopropoxide, monosec-butoxyaluminum diisopropoxide, aluminum sec-butoxide, aluminum ethoxide, diisopropoxy-(ethylacetoacetate)aluminum, tris(ethylacetoacetate) aluminum, tris (acetylacetonate) aluminum, bis-ethylacetoacetatemonoacetylacetonatealuminum, indium methoxide, indium ethoxide, indium isopropoxide, indium n-butoxide, antimony methoxide, antimony ethoxide, antimony isopropoxide, antimony n-butoxide, boron methoxide or boron n-butoxide.

15. A manufacturing process as claimed in claim 5, wherein said silane coupling agent is selected from the group consisting of vinyltrichlorosilane, vinyltriethoxysilane, vinyltris (β-methoxyethoxy) silane, γ-glycidoxypropyltrimethoxysilane, γ-methacryloxypropyltrimethoxysilane, γ-aminopropylmethydimethoxysilane, γ-chloropropyltrimethoxysilane, γ-mercaptopropyltrimethoxysilane, γ-aminopropyltrimethoxysilane, γ-aminopropyltriethoxysilane, methyltrimethoxysilane, dimethyldimethoxysilane, trimethylmonomethoxysilane, diphenyldimethoxysilane, diphenyldiethoxysilane, monophenyltrimethoxysilane, γ-(2-aminoethyl)aminopropyltrimethoxysilane, γ-(2-aminoethyl) aminopropylmethyldimethoxysilane, and γ-methacryloxypropyltrimethoxysilane.

16. A manufacturing process as claimed in claim 5, wherein said binder resin is a polyurethane resin, a polyvinylbutyral resin, a polyvinylformal resin or a polyvinyl acetate resin.

17. A manufacturing process as claimed in claim 5, wherein the amount of the silane coupling agent is in the range of 5%–95% by weight of the amount of the organic metal compound and the amount of the binding resin is in the range to 5%–25% by weight of the total amount of the organic metal compound and the silane coupling agent.

18. A manufacturing process as claimed in claim 5, wherein the amount of the silane coupling agent is in the range of 5%–50% by weight of the amount of the organic metal compound and the amount of the binding resin is in the range to 5%–25% by weight of the total amount of the organic metal compound and the silane coupling agent.

19. A manufacturing process as claimed in claim 5, wherein the amount of the silane coupling agent is in the range of 5%–20% by weight of the amount of the organic metal compound and the amount of the binding resin is in the range to 5%–25% by weight of the total amount of the organic metal compound and the silane coupling agent.

* * * * *